US008485097B1

(12) United States Patent
Nance et al.

(10) Patent No.: US 8,485,097 B1
(45) Date of Patent: Jul. 16, 2013

(54) ENERGETIC MATERIAL INITIATION DEVICE

(75) Inventors: Christopher J. Nance, Middletown, CA (US); John P. Segal, Calistoga, CA (US)

(73) Assignee: Reynolds Systems, Inc., Middletown, CA (US)

( * ) Notice: Subject to any disclaimer, the term of this patent is extended or adjusted under 35 U.S.C. 154(b) by 221 days.

(21) Appl. No.: 12/813,689

(22) Filed: Jun. 11, 2010

(51) Int. Cl.
*F42B 3/10* (2006.01)

(52) U.S. Cl.
USPC ..... 102/202.7; 102/200; 102/202.5; 102/202.9; 102/202.14; 102/275.11

(58) Field of Classification Search
USPC ..... 102/200, 202.5, 202.7, 202.9, 202.14, 102/264, 275.11
See application file for complete search history.

(56) References Cited

U.S. PATENT DOCUMENTS 2,415,045 A 1/1947 Seavey
3,805,115 A * 4/1974 Heckelman ..... 361/249
4,819,560 A 4/1989 Patz et al.
4,831,933 A 5/1989 Nerheim et al.
4,840,122 A 6/1989 Nerheim
4,852,494 A * 8/1989 Williams ..... 102/263
4,869,170 A 9/1989 Dahmberg et al.
5,230,287 A 7/1993 Arrell, Jr. et al.
5,347,929 A * 9/1994 Lerche et al. ..... 102/202.14
5,370,053 A 12/1994 Williams et al.
5,431,101 A 7/1995 Arrell, Jr. et al.
5,495,806 A 3/1996 Willey
5,641,997 A 6/1997 Ohta et al.
5,654,521 A 8/1997 McDaniel
5,912,428 A 6/1999 Patti
5,929,368 A * 7/1999 Ewick et al. ..... 102/215
5,969,286 A 10/1999 Ward et al.
6,079,332 A 6/2000 Marshall et al.
6,129,955 A 10/2000 Papathomas et al.
6,158,347 A 12/2000 Neyer et al.
6,227,115 B1 5/2001 Gruber et al.
6,255,728 B1 7/2001 Nasiri et al.
6,268,775 B1 * 7/2001 Patti ..... 331/111
6,311,621 B1 11/2001 Marshall et al.
6,341,562 B1 1/2002 Brisighella
6,408,759 B1 6/2002 Ewick et al.
6,463,857 B1 10/2002 Schmid et al.
6,467,414 B1 10/2002 Fisher
6,578,486 B2 6/2003 Mattes et al.
6,591,754 B1 7/2003 Baur et al.
6,644,197 B2 11/2003 Goernig et al.
6,659,010 B2 12/2003 Goernig et al.
6,718,884 B1 4/2004 Yabuta et al.

(Continued)

FOREIGN PATENT DOCUMENTS

JP 01248546 A 10/1989

*Primary Examiner* — Samir Abdosh
(74) *Attorney, Agent, or Firm* — Harness, Dickey & Pierce, P.L.C.

(57) ABSTRACT

A device for initiating an energetic material through an electrical pulse. The device includes an input charge, an initiator assembly and a switch. The input charge is formed of a secondary explosive. The initiator assembly is configured to initiate a detonation event in the input charge in response to receipt of the electrical pulse to a terminal that is electrically coupled to the initiator assembly. The switch is maintained in a normally open condition but is closed to transmit electrical energy from the pulse that remains on the first terminal after operation of the initiator assembly has been initiated.

28 Claims, 9 Drawing Sheets

U.S. PATENT DOCUMENTS

| | | | | |
|---|---|---|---|---|
| 6,732,655 | B1 | 5/2004 | Jakob et al. | |
| 6,739,264 | B1 | 5/2004 | Hosey et al. | |
| 6,753,922 | B1 | 6/2004 | Sengupta et al. | |
| 6,915,744 | B2 | 7/2005 | Tirmizi | |
| 6,923,122 | B2 | 8/2005 | Hennings et al. | |
| 7,007,973 | B2 | 3/2006 | Canterberry et al. | |
| 7,430,963 | B2 | 10/2008 | Hennings et al. | |
| 7,543,532 | B2 | 6/2009 | Nance | |
| 7,552,680 | B2 | 6/2009 | Nance et al. | |
| 7,571,679 | B2 * | 8/2009 | Nance | 102/202.9 |
| 7,581,496 | B2 | 9/2009 | Hennings et al. | |
| 7,661,362 | B2 | 2/2010 | Hennings et al. | |
| 7,690,303 | B2 | 4/2010 | Reynolds et al. | |
| 2002/0079030 | A1 | 6/2002 | Chan et al. | |
| 2007/0261584 | A1 * | 11/2007 | Nance et al. | 102/202.8 |
| 2008/0134921 | A1 * | 6/2008 | Nance | 102/202.5 |
| 2009/0266260 | A1 * | 10/2009 | Nance | 102/202.7 |

* cited by examiner

ENERGETIC MATERIAL INITIATION DEVICE

INTRODUCTION

The present disclosure generally relates to energetic material initiation devices and more particularly to energetic material initiation devices, (also known as initiators), such as to igniters and detonators.

U.S. Pat. Nos. 6,923,122 and 7,430,963 disclose initiators that employ the energy that is released from the detonation of an input charge to generate a pyrotechnic output. U.S. Pat. Nos. 6,851,370 and 7,552,680 disclose initiators that can be configured to produce a detonation event.

While these devices are well suited for their intended purposes, there remains a need in the art for an improved initiator.

SUMMARY

In one form, the present teachings provide a device that includes a housing assembly, an input charge, a first terminal, a second terminal, an initiator assembly and a switch. The housing assembly defines a cavity into which the input charge and the initiator assembly are disposed. The input charge is formed of a secondary explosive. The first and second terminals are received through the housing assembly and extend into the cavity. The initiator assembly is electrically coupled to the first terminal and is configured to initiate a detonation event in the input charge in response to receipt of an electrical pulse applied to the initiator assembly through the first terminal. The switch has a first contact, which is electrically coupled to the second terminal, and a second contact that is electrically coupled to the first terminal. The switch is maintained in an open state and closes within 5 micoseconds of the operation of the initiator assembly. For example, when the initiator assembly includes an exploding foil initiator having a bridge and a flyer that is expelled through a barrel in response to vaporization of the bridge, the switch is closed within 5 microseconds of the vaporization of the bridge.

In another form, the teachings of the present disclosure provide a device that includes a housing assembly, an input charge, a first terminal, a second terminal, an initiator assembly and a switch. The housing assembly defines a cavity into which the input charge and the initiator assembly are disposed. The input charge is formed of a secondary explosive. The first and second terminals are received through the housing assembly and extend into the cavity. The initiator assembly is electrically coupled to the first terminal and is configured to initiate a detonation event in the input charge in response to receipt of an electrical pulse applied to the initiator assembly through the first terminal. The switch has a first contact, which is electrically coupled to the second terminal, and a second contact that is electrically coupled to the first terminal. The switch is maintained in an open state and closes after operation of the initiator assembly to limit a current discharged from the first terminal to the housing assembly to less than 100 amps when a current in excess of 500 amps is employed to operate the initiator assembly.

In still another form, the present teachings provide a device that includes a housing assembly, an input charge, a first terminal, a second terminal, an initiator assembly and a switch. The housing assembly defines a cavity into which the input charge and the initiator assembly are disposed. The input charge is formed of a secondary explosive. The first and second terminals are received through the housing assembly and extend into the cavity. The initiator assembly is electrically coupled to the first terminal and is configured to initiate a detonation event in the input charge in response to receipt of an electrical pulse applied to the initiator assembly through the first terminal. The switch has a first contact, which is electrically coupled to the second terminal, and the second contact that is electrically coupled to the first terminal. The switch is maintained in an open state. Energy released from the detonation of the input charge is employed in the closing of the switch to limit the discharge of electrical energy from the first terminal to the housing assembly.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
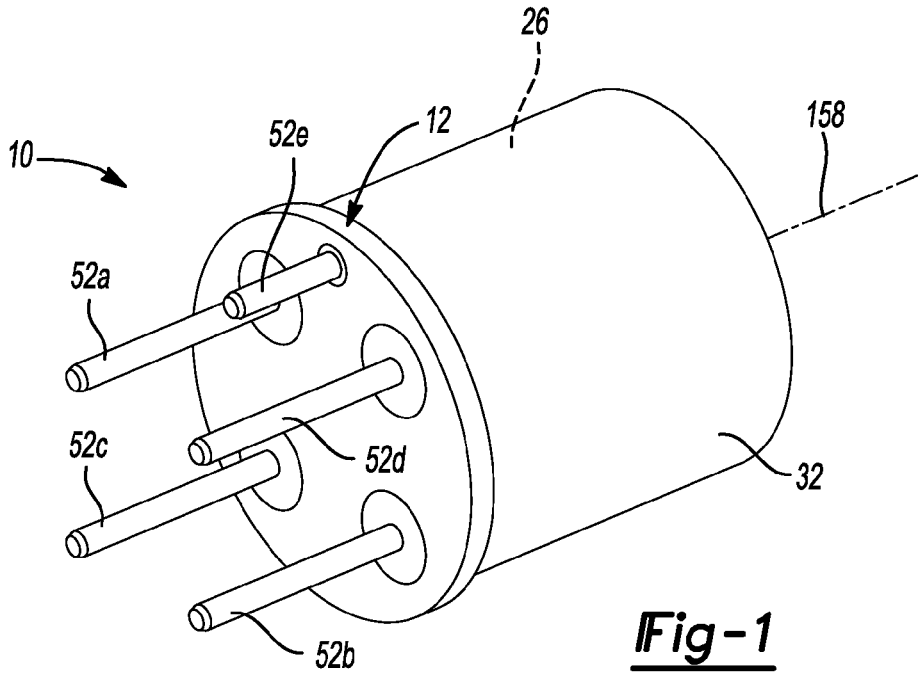
FIG. 1 is a rear perspective view of an energetic material initiation device constructed in accordance with the teachings of the present disclosure.
Figure 2:
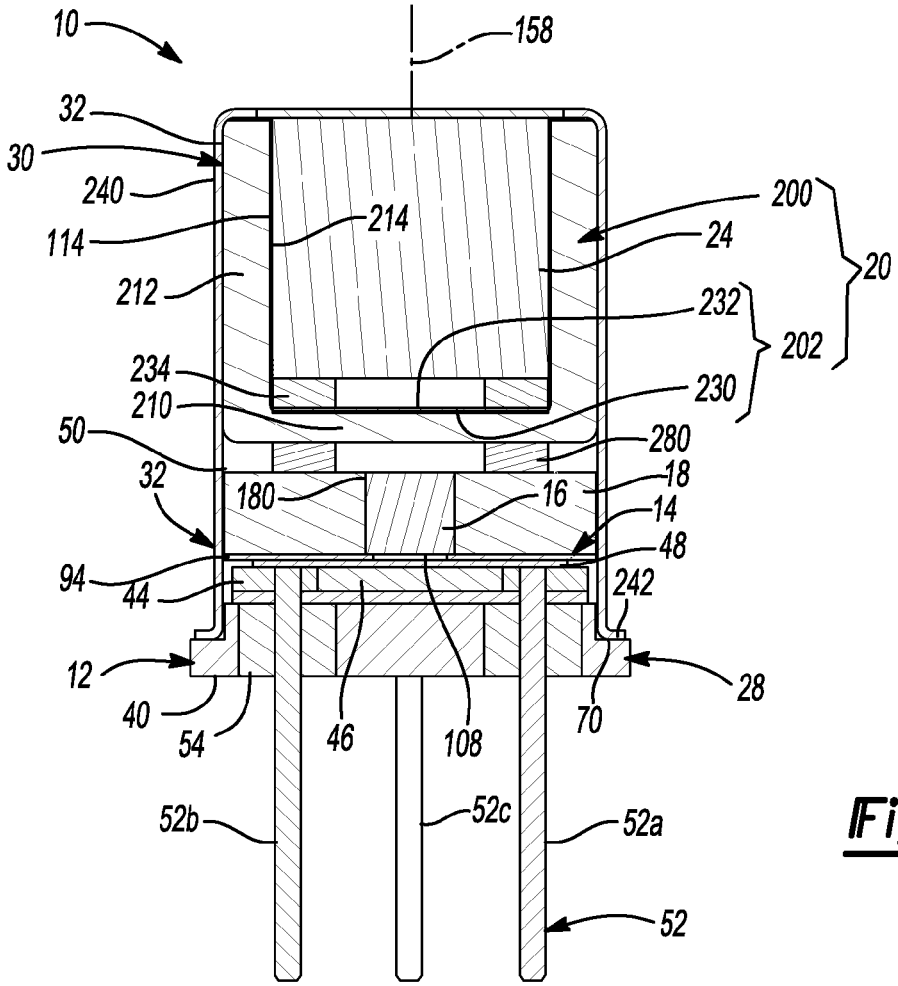
FIG. 2 is a longitudinal section view of the energetic material initiation device of FIG. 1.
Figure 3:
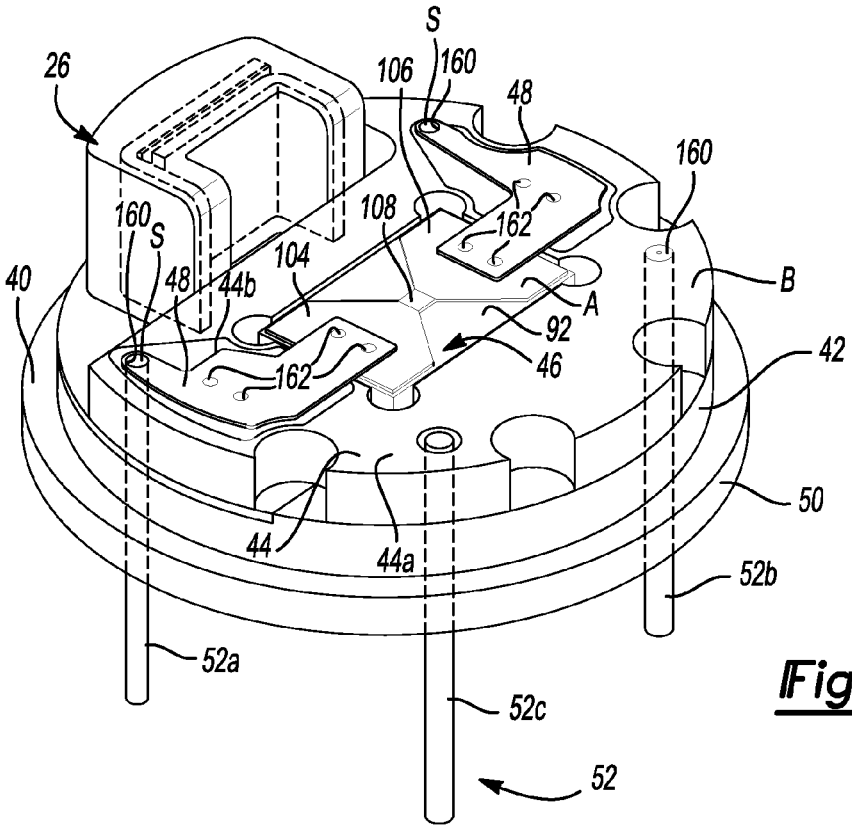
FIG. 3 is a front perspective view of a portion of the energetic material initiation device of FIG. 1, illustrating the header assembly in more detail.

With reference to FIGS. 1 through 3 of the drawings, an exemplary initiator constructed in accordance with the teachings of the present invention is generally indicated by reference numeral 10. The energetic material initiation device 10 can include a housing assembly 12, an input charge 16, an input sleeve 18, a barrier system 20, an output charge 24 and a grounding switch 26. In the particular example provided, the housing assembly 12 includes a header assembly 28 and a cover 32.

Figure 4:
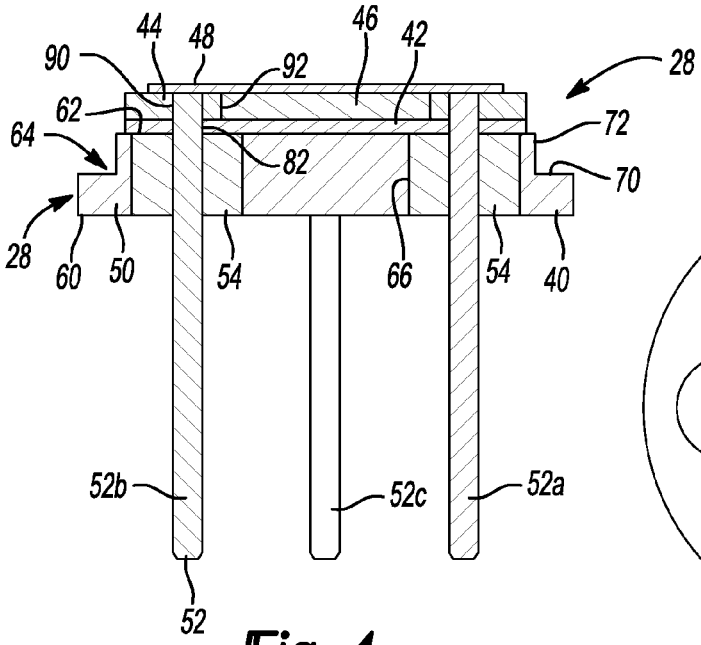
FIG. 4 is a longitudinal section view of the header assembly.

With reference to FIGS. 3 and 4, the header assembly 28 can include a header 40, an insulating spacer 42, a frame member 44, an initiator assembly 14 and a plurality of contacts 48. The header 40 can include a header body 50, a plurality of terminals 52, and a plurality of seal members 54.

Figure 5:
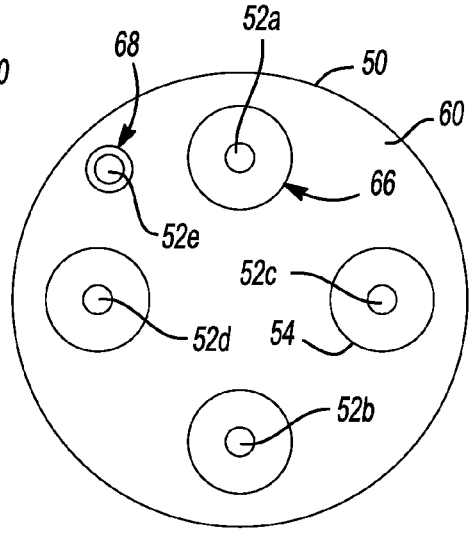
FIG. 5 is a bottom view of the header assembly.

The header body 50 can be formed of an appropriate material, such as KOVAR®, and can be shaped in a desired manner. The header body 50 can define first and second end faces 60 and 62, respectively, a shoulder 64, a plurality of first terminal apertures 66 and a second terminal aperture 68 (FIG. 5). The shoulder 64 can include an abutting face 70, which can be generally parallel to the first and second end faces 60 and 62, and a shoulder wall 72 that is generally perpendicular to the abutting face 70. The first terminal apertures 66 can be formed through the header body 50 generally perpendicular to the first and second end faces 60 and 62. The second terminal aperture 68 can be a blind hole that is formed in the header body 50 through the first end face 60.

With additional reference to FIG. 5, a first quantity of the terminals 52 (e.g., terminals 52*a* through 52*d*) can be received in respective ones of the first terminal apertures 66 and can extend outwardly from the first and second end faces 60 and 62. A remaining one of the terminals 52*e* can be received in the second terminal aperture 68 and can be fixedly and electrically coupled to the header body 50. In the particular example provided, the terminal 52*e* is soldered to the header body 50 and can serve as a means for electrically coupling the header body 50 to an electric ground (not shown). It will be appreciated that the terminals 52 can be arranged in a non-symmetrical manner to thereby key the header 40 in a particular orientation relative to the fireset device (not shown) to which the energetic material initiation device 10 is to be coupled. It will also be appreciated that a keying feature, such as a tab (not shown) or a recess (not shown), can be incorporated into a portion of the header 40 (e.g., the header body 50) to key the header 40 in a particular orientation.

The seal members 54 can be formed of a suitable material, such as glass conforming to 2304 Natural or another dielectric material, and can be received into an associated one of the first terminal apertures 66. The seal members 54 can sealingly engage the header body 50 as well as an associated one of the terminals 52.

Figure 6:
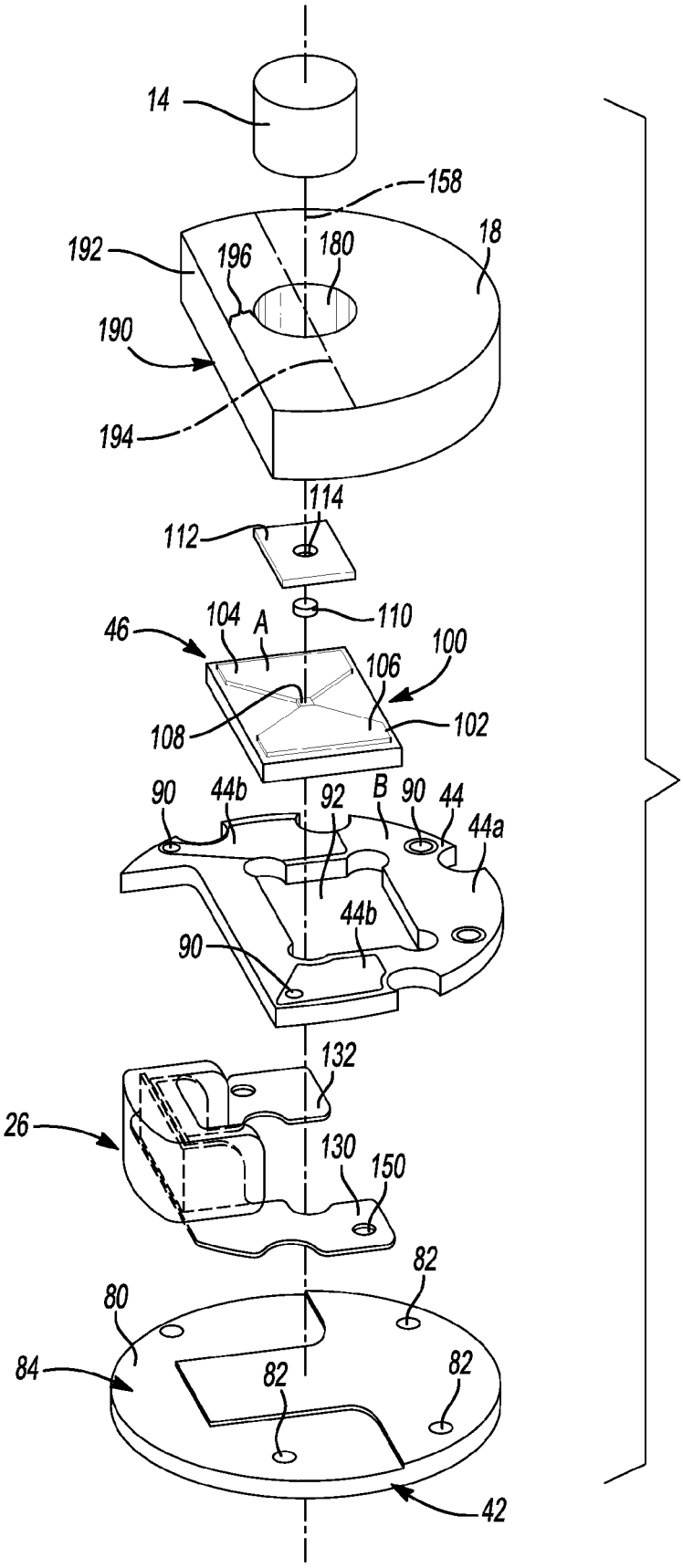
FIG. 6 is an exploded perspective view of a portion of the header assembly illustrating the insulating spacer, the frame member, the initiator chip, the input charge and the grounding switch in more detail.

With reference to FIGS. 4 and 6, the insulating spacer 42 can be formed of a suitable dielectric material, such as polycarbonate, synthetic resin bonded paper (SRBP) or epoxy resin bonded glass fabric (ERBGF), and can define a body 80 having a plurality of clearance apertures 82 that are sized to receive the terminals 52*a* through 52*d* (FIG. 1) there through. The body 80 can be received onto the second end face 62 and within an area that is defined by the size (i.e., perimeter) of the shoulder wall 72. The insulating spacer 42 may include a recessed zone 84 that can be configured to receive the grounding switch 26 as will be described in more detail below.

The frame member 44 can include a body 44*a* and a plurality of electrical conductors 44*b*. The body 44*a* can be formed of an appropriate dielectric material, such as synthetic resin bonded paper (SRBP) or epoxy resin bonded glass fabric (ERBGF). The conductors 44*b* can be arranged about the body 44*a* in a predetermined manner and can comprise one or more conductive layers of material, such as gold, silver, copper, nickel and alloys thereof. The conductors 44*b* can be formed onto the body 44*a* in any desired manner, such as through metallization of the entire surface of the body 44*a* and acid-etch removal of portions of the metallization that are not desired. The frame member 44 can be sized and shaped to closely conform to the size and shape of the insulating spacer 42 and can include a plurality of terminal apertures 90, an interior aperture 92 that is sized to receive the initiator assembly 14. The terminal apertures 90 can be sized to receive a corresponding one of the terminals 52 (e.g., terminals 52*a* through 52*c* in FIG. 1) therein. While the frame member 44 is illustrated as including terminal apertures 90 for only a portion of those terminals 52 that penetrate through the header 40, it will be appreciated that the frame member 44 could be configured differently.

In the particular example provided, the initiator assembly 14 includes an initiator chip 46 that comprises an exploding foil initiator 100 that is generally conventional in its construction and operation and as such, need not be described in exhaustive detail herein. Briefly, the exploding foil initiator 100 can include a base 102, a pair of bridge contacts 104 and 106, a bridge 108, a flyer 110 and a barrel 112. The base 102 can be a structural member that can be formed of a generally non-conductive material, such as a ceramic. The bridge contacts 104 and 106 and the bridge 108 can be fixedly coupled to the base 102 in a suitable manner (e.g., via vapor deposition) and can be formed of one or more layers of metallic material, including copper, silver, nickel, gold and alloys thereof. The bridge 108, which is disposed between the bridge contacts 104 and 106, is electrically coupled to the bridge contacts 104 and 106 therebetween. The flyer 110 can be formed of a suitable electrically insulating material, such as polyimide or parylene and can overlie at least the bridge 108 on a side of the bridge 108 opposite the base 102. The barrel 112, which can be formed of an electrically insulating material, such as a polyimide film, can be disposed over the flyer 110 and can be bonded to the base 102. The barrel 112 can define a barrel aperture 114 that can be located in-line with the flyer 110 and the bridge 108.

Figure 7:
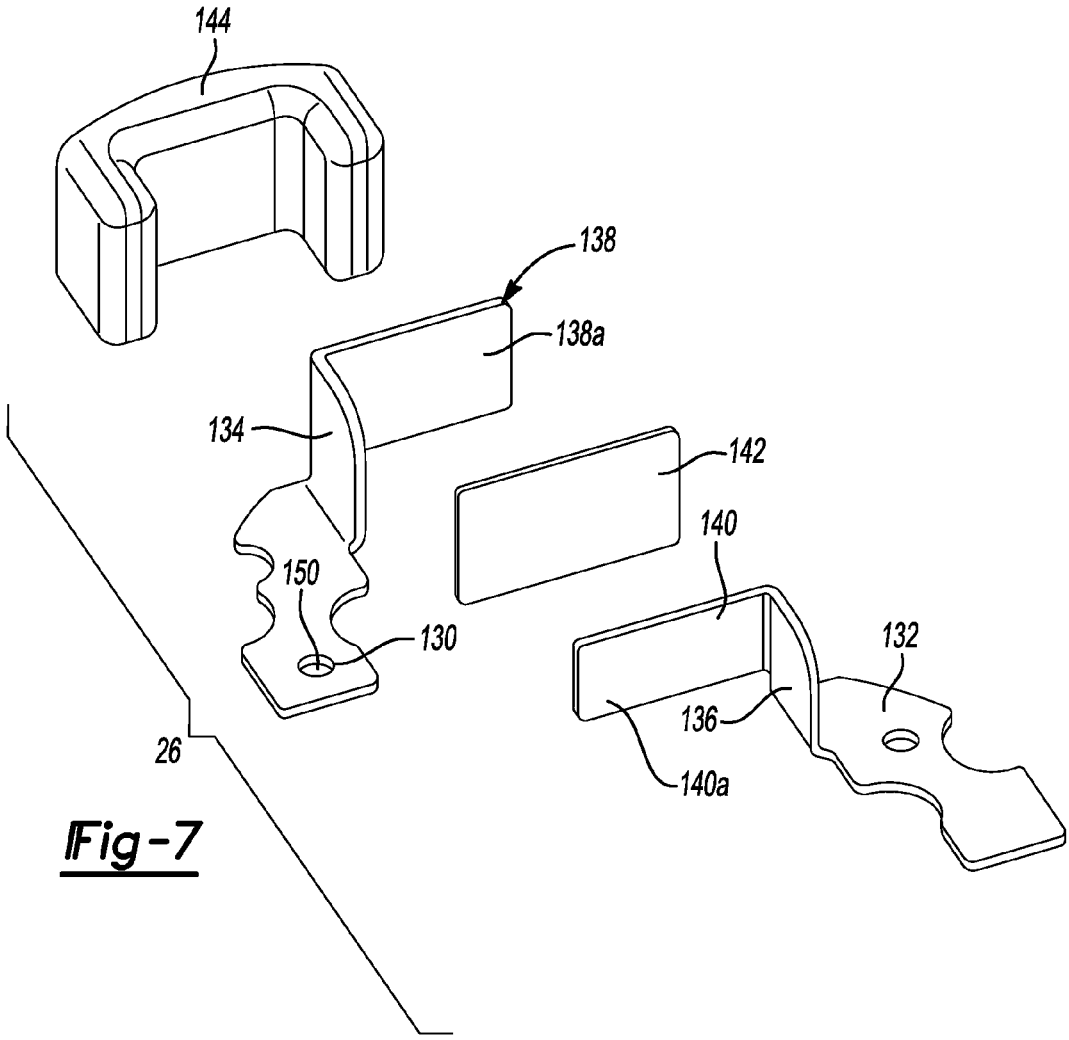
FIG. 7 is an exploded perspective view of the grounding switch.

With reference to FIGS. 3, 6 and 7, the grounding switch 26 can comprise a first grounding contact 130, a second grounding contact 132, a first connector member 134, a second connector member 136, a first switch member 138, a second switch member 140, a first insulating member 142 and a second insulating member 144. The first and second grounding contacts 130 and 132 can be flat, planar electrical contacts that can be formed of an appropriate conductive material, such as tin-lead plated copper, and can be received in the recessed zone 84 in the insulating spacer 42. The depth of the insulating zone 84 can be sized to receive all or a portion of the first grounding contact 130 and/or all or a portion of the second grounding contact 132. In the particular example provided, the first and second grounding contacts 130 and 132 are completely received in the recessed zone 84 and the depth of the recessed zone 84 is sized to match the thickness of the first and second grounding contacts 130 and 132. Configuration in this manner permits the grounding switch 26 to be integrated into the header assembly 28 in a relatively compact manner, but it will be appreciated that the first grounding contact 130 and/or the second grounding contact 132 could be positioned in another location, such as on the frame member 44 on a side opposite the insulating spacer 42. The first and second grounding contacts 130 and 132 can be configured to be electrically coupled to associated ones of the terminals 52. In the particular example provided, the first grounding contact 130 includes a terminal aperture 150 that can be employed to receive the terminal 52*a* therethrough, while the second grounding contact 132 is configured to abut an axial end of the terminal 52*c*. The electrical coupling of the terminals 52*a* and 52*c* to the first and second grounding contacts 130 and 132, respectively, will be discussed in more detail, below.

The first connector member 134 can be fixedly and electrically coupled to the first grounding contact 130 and the first switch member 138 therebetween. It will be appreciated that the first grounding contact 130, the first connector member 134 and the first switch member 138 can be integrally formed from a suitable conductive material. In the example illustrated, the first connector member 134 includes a portion that is disposed orthogonally to the first grounding contact 130 and the first switch member 138 so as to reduce or minimize the surface area that may be impacted by fragments produced following detonation of the input charge 16 as compared with other configurations. It will be appreciated, however, that the teachings of the present disclosure are broader than the particular embodiment illustrated and that the first connector member 134 could be formed in another manner/shape. The first switch member 138 can comprise a first conductive target 138*a* that can be configured to extend away from the insulating spacer 42 in a desired manner. In the particular example provided, the first conductive target 138*a* is disposed in a plane that is generally parallel to a longitudinal axis 158 (FIG. 1) of the energetic material initiation device 10 (FIG. 1). The first connector member 134 and the first switch member 138 can extend above the frame member 44 so as to lie proximate the input sleeve 18 as will be discussed in more detail below. It will be appreciated that the first grounding contact 130, the first connector member 134 and the first switch member 138 can be configured somewhat differently from that which is depicted in the accompanying illustrations. For example, the first connector member 134 and the first switch member 138 may be formed as a curved planar surface.

The second connector member 136 can be fixedly and electrically coupled to the second grounding contact 132 and the second switch member 140 therebetween. It will be appreciated that the second grounding contact 132, the second connector member 136 and the second switch member 140 can be integrally formed from a suitable conductive material. In the example illustrated, the second connector member 136 includes a portion that is disposed orthogonally to the second grounding contact 132 and the second switch member 140 so as to reduce or minimize the surface area that may be impacted by fragments produced following detonation of the input charge 16 as compared with other configurations. It will be appreciated, however, that the teachings of the present disclosure are broader than the particular embodiment illustrated and that the second connector member 136 could be formed in another manner/shape. The second switch member 140 can comprise a second conductive target 140*a* that can be offset from the first conductive target 138*a* and can be configured to extend away from the insulating spacer 42 in a desired manner. In the particular example provided, the second conductive target 140*a* is disposed in a plane that is generally parallel to a longitudinal axis 158 (FIG. 1) of the energetic material initiation device 10 (FIG. 1). The second connector member 136 and the second switch member 140 can extend above the frame member 44 so as to lie proximate the input sleeve 18 as will be discussed in more detail below. It will be appreciated that the second grounding contact 132, the second connector member 136 and the second switch member 140 can be configured somewhat differently from that which is depicted in the accompanying illustrations. For example, the second connector member 136 and the second switch member 140 may be formed as a curved planar surface.

The first insulating member 142 can be received between the first and second conductive targets 138*a* and 140*a* and can electrically insulate the first switch member 138 from the second switch member 140. In the particular example provided the first insulating member 142 is sized larger than the first and second conductive targets 138*a* and 140*a* to extend outwardly from the first and second conductive targets 138*a* and 140*a* in vertical and horizontal directions. For example, the first insulating member 142 can be formed of a Kapton film and can have a suitable thickness, such as a thickness of 0.001 inch. It will be appreciated that other types of insulating materials can be employed including air, an inert gas or a vacuum, or that a combination of insulating materials could be employed. The first insulating member 142 can be coupled to the one or both of the first and second switch members 138 and 140 in any desired manner, such as with a suitable adhesive.

The second insulating member 144 can be formed of an electrically insulating material that can be coated, deposited or fitted onto the first and second switch members 138 and 140 and the first and second connector members 134 and 136 to thereby form a barrier that electrically insulates the first and second switch members 138 and 140 and the first and second connector members 134 and 136 from the housing assembly 12 (FIG. 2). In the particular example provided, the second insulating member 144 is formed of LCP and has a thickness of about 0.010 min, but it will be appreciated that if included, the second insulating member 144 could be thicker or thinner could be thicker. Depending on the particular design, the second insulating member 144 can be employed for one or more functions for the first and second connector members 134 and 136 and/or the first and second switch members 138 and 140, such as: providing structural support; providing electrical insulation from other components; and/or containment of materials fragmented by the initiator assembly and/or the detonation of the input charge 16.

While the first and second switch members 138 and 140 have been shown and described in a particular order (i.e., with the second switch member 140 being radially inward of the first switch member 138), it will be appreciated that the positioning of the first and second switch members 138 and 140 could be reversed (i.e., so that the first switch member 138 is radially inward of the second switch member 140).

Figure 8:
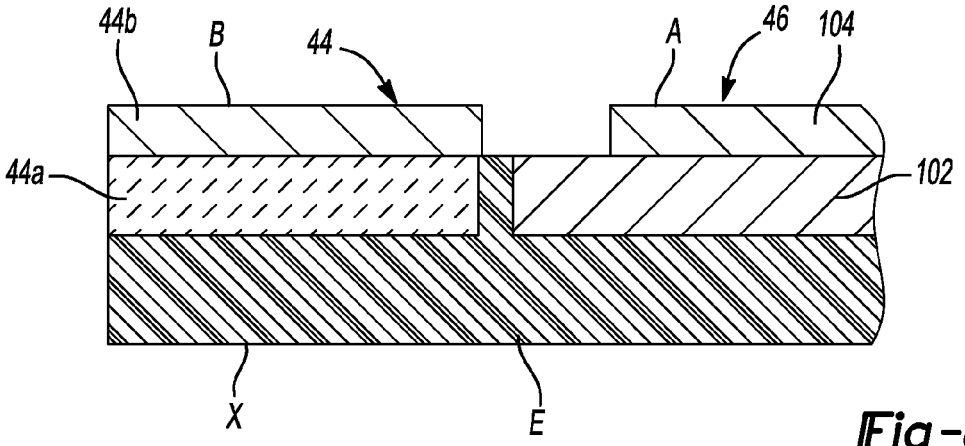
FIG. 8 is a section view of a portion of the header assembly illustrating the initiator chip, the frame member and an epoxy.

With reference to FIGS. 3, 6 and 8, the initiator chip 46 can be received in the interior aperture 92 that is formed by the frame member 44. In the particular example provided, an adhesive, such as SCOTCH-WELDT™ EC-2216 Grey epoxy marketed by Minnesota Mining and Manufacturing Company of St. Paul, Minn., is employed to bond the frame member 44, the first and second grounding contacts 130 and 132 and the initiator chip 46 to the insulating spacer 42 as well as to bond the insulating spacer 42 to the header body 50. It will be appreciated that the surface A of the initiator chip 46 and the surface B of the frame 44 can be abutted against a flat surface so that the surfaces A and B will be substantially parallel and co-planar. The epoxy E can be applied to the surfaces of the initiator chip 46 and the frame member 44 opposite the surfaces A and B, respectively. The epoxy E can be employed to secure the frame member 44 and the initiator chip 46 to one another, as well as to provide a bottom surface X of the assembly that is generally parallel to the surfaces A and B. In this way, the top and bottom surfaces of the assembly (i.e., the frame member 44, the initiator chip 46 and the epoxy E) can be flat and parallel within a desired tolerance, such as 0.001 inch. The terminal apertures 90 can be formed via a suitable process, such as drilling.

Figure 9:
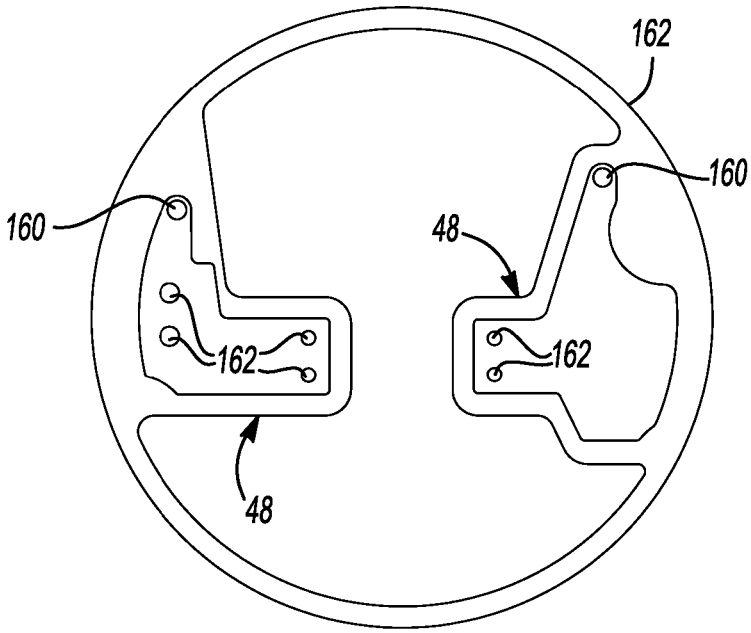
FIG. 9 is a top plan view of a portion of the header assembly illustrating the contacts as coupled to a lead frame prior to assembly to the frame member and the initiator chip.

With reference to FIGS. 3 and 9, the contacts 48 can be formed of a suitable electrically conductive material, such as KOVAR® having a thickness of about 0.003 inch, and can include a terminal aperture 160 that can receive an associated one of the terminals 52*a* and 52*b* and a plurality of solder apertures 162. The contacts 48 can be shaped to engage an associated electric interface (i.e., the first bridge contact 104 and the second bridge contact 106). In the particular example provided, the contacts 48 are soldered to an associated one of the terminals 52*a* and 52*b* and an associated one of the electric interfaces with an appropriate solder S (FIG. 3), while the second grounding contact 132 is soldered directly to the terminal 52*c*. One suitable solder is a F540SN62-86D4 solder paste marketed by Heraeus Inc., Circuit Materials Division of Scottsville, Ariz. The solder apertures 162 permit solder to flow through the contacts 48 in predetermined areas, such as locations in-line with the associated electric interfaces and in-line with the conductors 44*b* (FIG. 6) of the frame member 44. Accordingly, it is possible to visually-inspect the solder joints associated with each contact 48 through the solder apertures 162 and the terminal aperture 160. It will be appreciated that the flyer 110 and the barrel 112 may be assembled to the remainder of the initiator chip 46 after the soldering operation.

We have found it to be desirable to form the contacts 48 such that they are connected to one another and form a lead frame 162. The terminals 52 can be received in a high-tolerance fixture (not shown), the insulating spacer 42, the first grounding contact 130, and the frame 44 can be placed onto the terminals 52 using at least some of the terminals 52 as guide pins. The lead frame 162 can be oriented to the header body 50 and thereafter the lead frame 162 and the header body 50 can be clamped together via an assembly fixture (not shown). The header body 50 and the lead frame 162 can be processed through a reflow oven to solder the contacts 48 to the terminals 52, the conductors 44*b* (FIG. 6) and the associated electric interfaces in a single soldering operation. The header assembly 28 can thereafter be separated from the lead frame 162 by shearing the contacts 48 from the lead frame 162. The insulating spacer 42 can prevent the contacts 48 from shorting to the header body 50. Moreover, the contacts 48 can be sheared from the lead frame 162 in a direction that drives the sharp edges of the contacts 48 into the frame member 44. It will be appreciated that as a force is applied to assembly prior to the soldering of the contacts 48, the terminals 52, the solder and the contacts 48 will cooperate to apply maintain this force on the frame member 44 and the initiator chip 46.

It will be appreciated that the thicknesses of the barrel 112, the contacts 48 and the solder that couples the contacts 48 to the terminals 52 and the electric interfaces can be selected to space the bridge 108 (FIG. 6) apart from the input charge 16 by a predetermined spacing, such as about 0.004 inch to about 0.008 inch. It will be also appreciated that it can be important in some situations that the contacts 48 be relatively flat so as not to affect the spacing between the bridge 108 (FIG. 6) and the input charge 16.

With reference to FIGS. 2 and 6, the input sleeve 18 can be configured to support the input charge 16 and direct energy from the input charge 16 in a desired direction. In the particular example provided, the input sleeve 18 is formed of a suitable structural material, such as steel. The input sleeve 18 can define a cavity 180 that can be located in-line with the bridge 108. The input sleeve 18 can be generally washer-like in shape and can define at least one frangible or structurally weakened zone 190. In the particular example provided, the weakened zone 190 is defined by a flat, planar edge 192 of the input sleeve 18 that extends across the input sleeve 18 generally parallel to a centerline 194 of the cavity 180 and perpendicular to the longitudinal axis 158 (FIG. 1) (i.e., central axis of the annular or washer shape that defines the remainder of the input sleeve 18) so as to form a span 196 of a relatively narrow width between the cavity 180 and the edge 192. It will be appreciated, however, that the zone 190 could be formed or shaped differently as will be discussed in more detail, below. It will be appreciated that in some applications the input sleeve 18 may be omitted or may be integrally formed with a structure that also performs some or all of the function of the header body 50.

The input charge 16 can be formed of a suitable energetic material, such as RSI-007, which is available from Reynolds Systems, Inc. of Middletown, Calif. It will be appreciated however that various types of secondary explosives, such as HNS-I, HNS-IV, PETN, NONA, CCLS-20 FPS, and combinations thereof, could be employed for all or a portion of the input charge 16. The input charge 16 can be received in the cavity 180 in the input sleeve 18 and compacted to a desired density. It will be appreciated that in some applications, the input charge 16 may fill the entire volume of the cavity 180.

With reference to FIG. 2, the barrier system 20 can be configured to attenuate the energy released during detonation of the input charge 16, for example to initiate combustion or deflagration in the output charge 24. It will be appreciated that for some types of initiators, such as detonators, attenuation of the energy released during detonation of the input charge 16 may be unnecessary or undesirable and as such, a barrier system may not be included in some initiators constructed in accordance with the teachings of the present disclosure.

In one exemplary form, the barrier system 20 can comprise a first barrier structure 200 and a second barrier structure 202. The first barrier structure 200 can include a cup-shaped structure having a bottom wall 210 and an annular side wall 212 that cooperate to form a cavity 214. The thickness of the bottom wall 210 can vary depending on several design factors, including the material and size of the input charge 16 and the material and size of the output charge 24. In the particular example provided, the bottom wall 210 can have a thickness of about 0.020 inch to about 0.080 inch and preferably about 0.040 inch to about 0.060 inch. The first barrier structure 200 can be formed of a material such as 304 stainless and can be positioned in-line with the input charge 16. The annular side wall 212 can extend upwardly away from the header assembly 28.

With renewed reference to FIGS. 3 and 4, the second barrier structure 202 can be received in the cavity 214 and disposed between the first barrier structure 200 and the output charge 24. The second barrier structure 202 can at least partially burn in response to the high heat and pressure of the detonating input charge 16 to thereby ignite the output charge 24. In the example illustrated, the second barrier structure 202 is a composite that includes a reactable member 230, which can be formed from a metal such as titanium or another suitably reactive material that is inert under normal circumstances, and an oxidizer member 232, which can be formed from a material such as TEFLON® (i.e., polytetrafluoroethylene). In the particular example provided, the reactable member 230 is formed of titanium and has a thickness of about 0.001 inch, while the oxidizer member 232 is formed of TEFLON® and has a thickness of about 0.001 inch.

The output charge 24 can be formed from a suitable material, such as a material that may be used for initiating ignition or deflagration in a pyrotechnic material. In the example provided, the output charge 24 is formed from boron potassium nitrate ($BKNO_3$) and can be disposed within the cavity 214 in the first barrier structure 200. Optionally, a resilient member 234, such as a silicone rubber washer, can be disposed between the second barrier structure 202 and the output charge 24 and/or between the output charge 24 and the cover 32.

While the first and second barrier structures 200 and 202 are illustrated in the accompanying drawings as being situated such that energy released by the input charge 16 contacts or reacts with the first barrier structure 200 prior to contacting or reacting with the second barrier structure 202, it will be appreciated that it may be possible or desirable to reverse the orientation of the first and second barrier structures 200 and 202.

With reference to FIG. 2, the cover 32 can be formed of a suitable material, such as KOVAR®, and can include a cover body 240 and a rim 242. The cover body 240 can be a cup-line structure that can receive the portion of the energetic material initiation device 10 outwardly of the abutting face 70. The rim 242 can extend radially outwardly from the cover body 240 and can matingly engage the abutting face 70. The rim 242 and the shoulder 64 (FIG. 4) can be welded in an appropriate manner (e.g., laser welded) to fixedly and sealingly couple the cover 32 to the header body 50. It will be appreciated that a preload force can be applied to the cover 32 to seat the cover 32 to the header body 50 and as such, various components of the energetic material initiation device 10, such as the output charge 30, the barrier 28, the frame 44 and the initiator chip 46 can be maintained in a state of compression.

In situations where the first barrier structure 200 is formed of an electrically conductive material, an insulator 280 can be positioned between the input sleeve 18 and the first barrier structure 200.

With renewed reference to FIGS. 2, 3 and 6, when the energetic material initiation device 10 is to be activated, a high current pulse, typically in excess of 1000 amps, is applied to the terminal 52*a*. While the terminal 52*a* is coupled to the first grounding contact 130, the first insulating member 142 inhibits the transmission of electrical energy between the first and second switch members 138 and 140 so that the electrical energy cannot be coupled to an electrical ground via the second grounding contact 132 and the terminal 52*c*. The terminal 52*b* is coupled to an electrical ground, however, and as such, the high current pulse flows through the bridge 108, causing the bridge 108 to vaporize and form a hot, high pressure plasma that propels the flyer 110 at a relatively high velocity through the barrel aperture 114 in the barrel 112 where it impacts the input charge 16 and causes the input charge 16 to detonate. The input charge 16 can be formed of a suitable material, such as an RSI-007 material manufactured by Reynolds Systems Inc. of Middletown, Calif., that permits a shock wave having full detonation velocity to develop despite the relatively small size of the input charge 16.

As described above, energy released from the detonation of the input charge 16 can cause a reaction in the barrier system 20 that attenuates the energy and initiate a combustion or deflagration event in the output charge 24.

In the particular example provided, the first barrier structure 200 attenuates the shock wave that is produced during detonation of the input charge 16. The first barrier structure 200 is not configured to rupture as a result of the detonation of the input charge 16 in the particular example illustrated, but those of ordinary skill in the art will appreciate that the first barrier structure 200 could be configured to rupture in response to detonation of the input charge 16. Energy that is transmitted through the first barrier structure 200 can be employed to initiate a reaction of the second barrier structure 202 wherein the second barrier structure 202 ignites and/or burns. Stated another way, at least a portion of the second barrier structure 202 participates in a chemical reaction in which the second barrier structure 202, in whole or in part, oxidizes and burns to ignite the output charge 24.

Ignition of the output charge 24 generates heat and pressure within the confined space of the housing assembly 12 that can cause the cover to rupture and produce an output kernel or pyrotechnic output that is capable of igniting an adjacent pyrotechnic material (not shown), such as the fuel of a rocket motor (not shown). The seal members 54 can be configured to maintain the integrity of the seal between the header body 50 and the associated terminal 52 when the energetic material initiation device 10 is activated.

We have found that the timing of the closing of the grounding switch 26 relative to the vaporization of the bridge 108 can be critical in some situations so that it would be desirable to close the grounding switch 26 as soon as possible after the vaporization of the bridge 108. We have approximated the time lag between the vaporization of the bridge 108 and the closing of the grounding switch 26 by monitoring the current that is discharged through the housing 12 during the detonation sequence. We have noted that it is possible to have brief current pulses in excess of several hundred amps in similar initiators that are not equipped with a grounding switch (where the current supplied to the initiator to trigger initiation of the input charge 16 exceeds 500 amps). In contrast, an initiator configured in accordance with the present teachings may, if desired, be configured to reliably limit such current pulses to a level of less than 100 amps, preferably less than 10 amps and more preferably less than 2 amps and still more preferably less than 1 amp.

Various means may be employed to close the grounding switch 26, either on a temporary basis or a permanent basis. For example, the detonation of the input charge 16 and/or a portion of the energy produced by the detonation of the input charge 16 can be employed to close the grounding switch 26.

Figure 10:
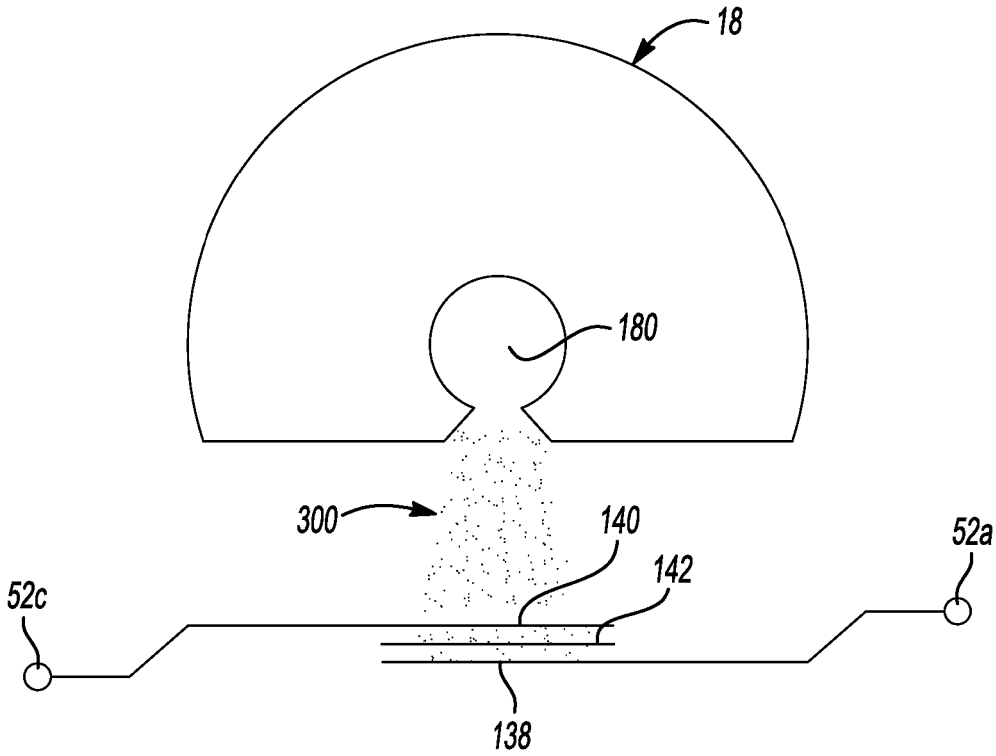
FIG. 10 is a top plan view of a portion of the initiator of FIG. 1 illustrating the input sleeve after detonation of the input charge to form a fragmented portion that can be employed in some embodiments to close the grounding switch.

For example, energy released by the detonation of the input charge 16 can be employed to fragment a portion of the input sleeve 18, such as at a portion of the input sleeve 18 proximate the weakened zone 190, and propel the fragmented portion of the input sleeve 18 through the second insulating member 144 and against the first and second switch members 138 and 140 to cause electrical contact between the first and second switch members 138 and 140 (either directly or employing portions of the fragments of the input sleeve 18 as a conductor as shown in FIG. 10). For example, the fragmented portion 300 (FIG. 10) could penetrate the second insulating member 144, the second switch member 140 and the first insulating member 142 to electrically couple the first and second switch members 138 and 140.

As another example, energy released during the detonation event could be employed to close the grounding switch 26. In this regard, a compressive force, which can be applied to the grounding switch 26 as a result of the detonation event, can cause the second switch member 140 to puncture or travel through the first insulating member 142 and electrically contact the first switch member 138. Additionally or alternatively, the compressive force applied to the ground switch 26 could cause the first insulating member 142 to temporarily or permanently change from an electric insulator to an electric conductor.

As a further example, the plasma generated during vaporization of the bridge 108 that is scattered during the detonation event and/or electrical charges generated during the detonation event may be employed to temporarily or permanently close the grounding switch. We are of the opinion that the detonation wavefront is electrically charged. Consequently, an associated electric field produced by the electrically-charged wavefront could lower the electric potential needed to pass current from the second switch member 140 through the first insulating member 142 and into the first switch member 138. The electrically-charged nature of the wavefront may be due to the stripping of electrons from atoms in the material that forms the components that surround the input charge 16 when the input charge 16 is being detonated and/or from the provision of plasma or ionized particles generated by the detonation event or evens that initiate the detonation event.

It will be appreciated that any suitable means may be employed to close the grounding switch 26 and that two or more of such means may be employed to close the grounding switch 26.

Those of skill in the art will appreciate that residual energy remaining on the terminal 52*a* after vaporization of the bridge 108 can be directed to an electrical ground via a predetermined electrical path by closing the grounding switch 26. In the event that the grounding switch 26 is only temporarily closed, it will be appreciated that residual energy not transmitted through the grounding switch 26 may find a path to ground via the housing 12, which can result in a current pulse as described above.

As noted above, the time lag between the vaporization of the bridge 108 and the closing of the grounding switch 26 can be important to reduce the amount of residual energy (on the terminal 52*a*) that is discharged to the housing 12 and as such, it can be desirable to reduce the time lag and/or to increase the amount of time that is needed to begin to discharge residual energy to the housing 12.

Figure 11:
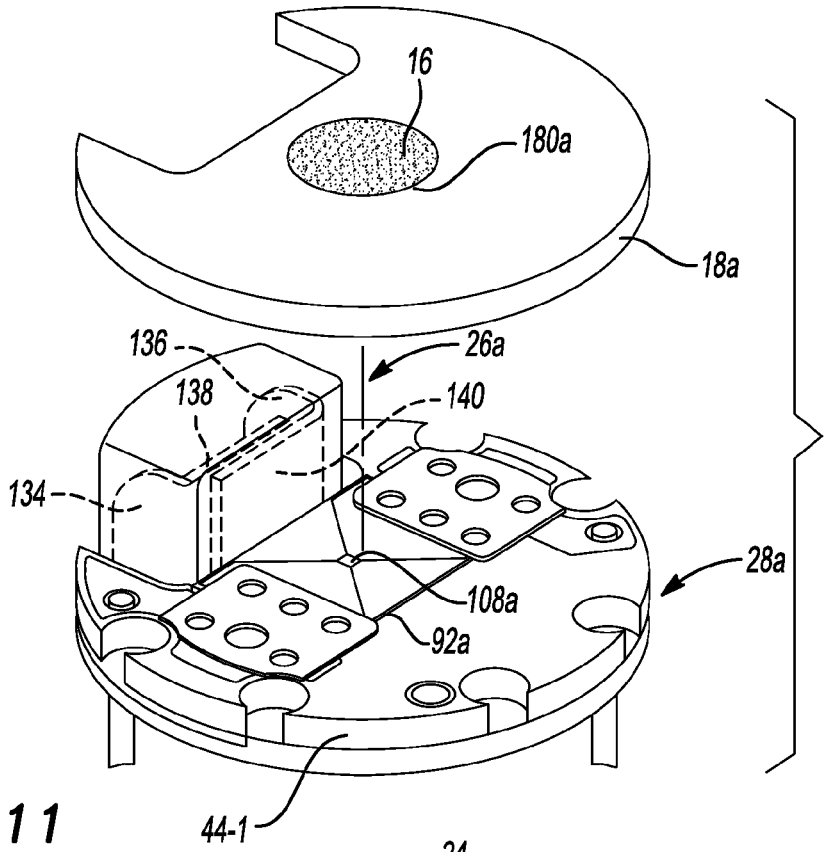
FIG. 11 is an exploded perspective view of a portion of another energetic material initiation device constructed in accordance with the teachings of the present disclosure.

With reference to FIG. 11, the grounding switch 26*a* could be altered relative to the grounding switch 26 of FIG. 1 to position the first and second switch contacts 138 and 140 on the first and second connector members 134 and 136, respectively, so as to be in closer proximity to the input charge 16 (i.e., positioned radially inwardly relative to the example illustrated in FIG. 1). Note that the second insulating member 144 (FIG. 7) is not shown for purposes of clarity. Additionally or alternatively, the input sleeve 18*a* and/or the initiator assembly and/or the housing assembly can be constructed so as to position the input charge in closer proximity to the grounding switch. In the example provided, the frame member 44-1 of the header assembly 28*a* is constructed such that the interior aperture 92*a* is offset from the central axis of the header assembly 28*a* so as to position the bridge 108*a* and the input charge 16 radially outward from the central axis toward (i.e., in closer proximity to) the grounding switch 26*a*. It will be appreciated that the cavity 180*a* in the input sleeve 18*a* may be shifted radially outwardly by an equivalent amount.

Figure 16:
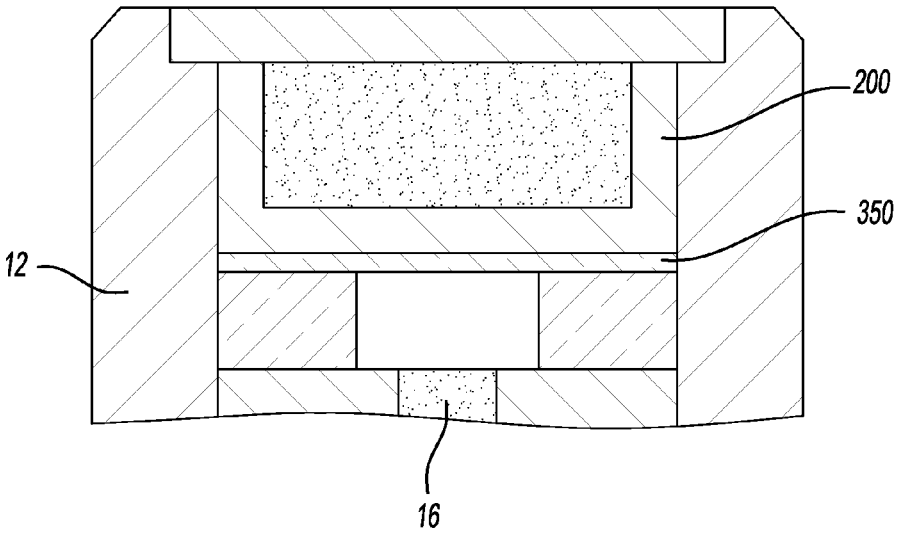
FIG. 16 is a longitudinal section view of a portion of another energetic material initiation device constructed in accordance with the teachings of the present disclosure.

Additionally or alternatively, an insulating member 350 can be abutted against the first barrier member 200 on a side adjacent the input charge 16 as shown in FIG. 16. We have found, for example, that a 0.002 inch layer of polytetrafluoroethylene (e.g., TEFLON®) has been effective in delaying or preventing electrons carried with the detonation wavefront from grounding to the housing assembly 12 through the first barrier member 200. It will be appreciated that other insulating materials could be employed and/or that such insulating materials could be incorporated into the first barrier member 200 (e.g., in the form of a coating, which could be formed, for example, from a ceramic or a plastic material).

Figure 12:
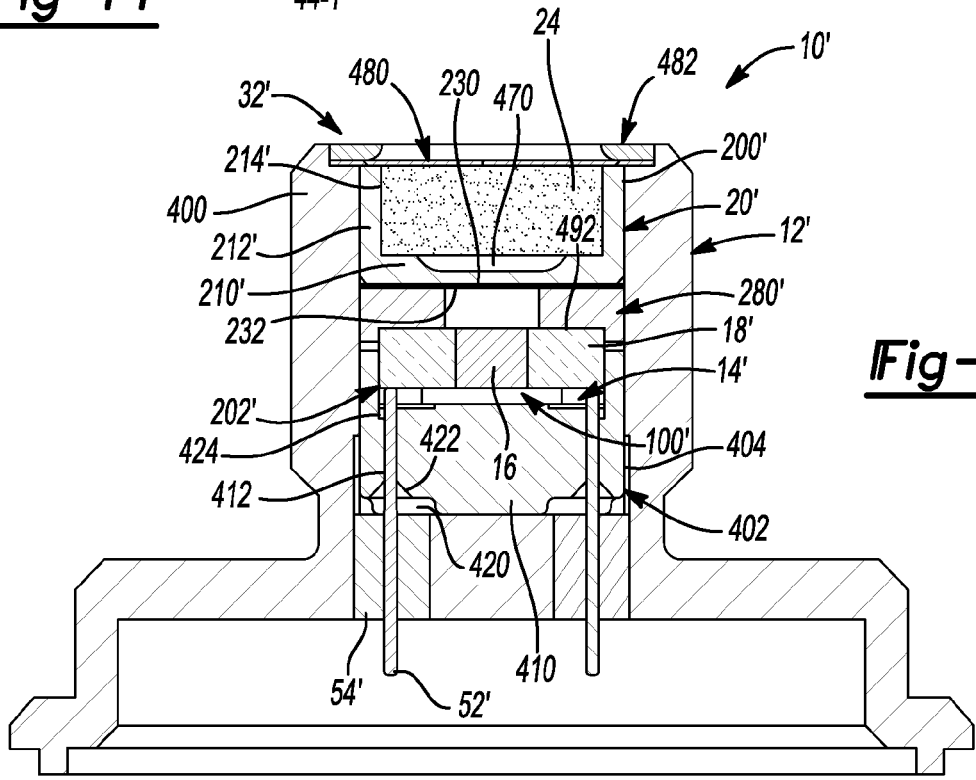
FIG. 12 is a longitudinal section view of another energetic material initiation device constructed in accordance with the teachings of the present disclosure.
Figure 13:
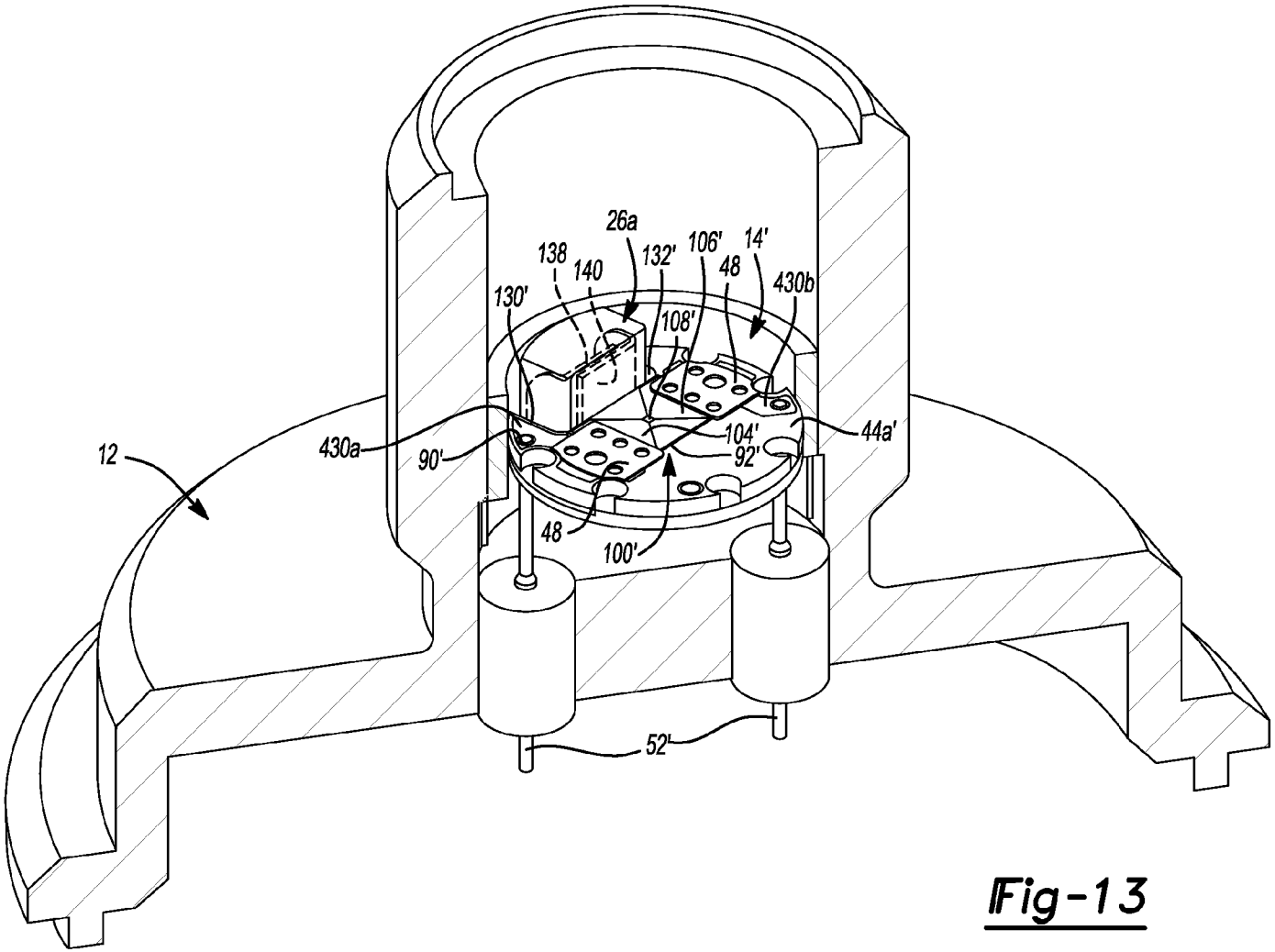
FIG. 13 is a perspective view of a portion of the energetic material initiation device of FIG. 12.

With reference to FIGS. 12 and 13, another initiator constructed in accordance with the teachings of the present disclosure is generally indicated by reference numeral 10'. The energetic material initiation device 10' can be generally similar to the initiator disclosed in U.S. Pat. No. 7,430,963, but has been modified somewhat to include a grounding switch and to vary the timing of the operation of the grounding switch. The disclosure of U.S. Pat. No. 7,430,963 is incorporated by reference as if fully set forth in detail herein.

Briefly, the energetic material initiation device 10' can include a housing assembly 12', an initiator assembly 14', an input charge 16, an input sleeve 18', a barrier system 20', an output charge 24 and the grounding switch 26*a*.

The housing assembly 12' can include a housing 400, a plurality of terminals 52', a plurality of seal members 54', a spacing member 402 and a cover 32'. The housing 400 can be formed of any suitable material, such as 304 stainless, and can define an internal cavity 404. The terminals 52' can be formed of an appropriate material, such as an iron-nickel alloy conforming to SAE-AMS-I-23011 Class II having a layer of electrolytic nickel plating and an outer layer of gold plating. The terminals 52' can be stepped in diameter (i.e., having a first portion of a first diameter, such as 0.020 inch, and a second portion of a second, smaller diameter, which can be about 40% to about 95% of the first diameter and more preferably about 55% to about 90% of the first diameter). The seal members 54' can be formed of an appropriate material, such as a glass conforming to 2304 Natural or other dielectric material and can be positioned relative to the housing 400 so as not to extend into the internal cavity 404 (i.e., the seal members 54' can be flush or below the portion of the housing 400 that defines the bottom of the internal cavity 404). Each seal member 54' can be disposed in a respective seal aperture formed in the housing 400 and can form a seal between the housing 500 and a respective one of the terminals 52'. The seal created by each seal member 54' can be configured to withstand a predetermined pressure, such as 5,000 p.s.i.g. for a predetermined amount of time, such as one minute, without permanent deformation or structural failure, and/or can be configured to leak at a rate that does not exceed a predetermined rate, such as $1\times10^{-6}$ cc per second at one atmosphere of gage pressure. The terminals 52' can be positioned relative to respective seal members 54' such that the smaller diameter second portion of the terminals 52' extends into the internal cavity 404.

The spacing member 402 can be formed of a suitable dielectric, such as polycarbonate, and can include a body 410 that is sized to be received into the internal cavity 404. The body 410 can define a pair of apertures 412 through which the terminals 52' can be received. The apertures 412 can be formed with a counterbore 420 and countersink 422 on a first side of the body 410 and a pocket 424 on a second side of the body 410. Each counterbore 420 can be configured to define a chamber that is located about an associated one of the terminals 52' when the spacing member 402 is fully inserted into the internal cavity 404, while the countersink 422 can help to align the spacing member 402 to a respective one of the terminals 52'.

The initiator assembly 14' can be any type of device that is configured to initiate a detonation event in response to receipt of a pulse of electrical energy. For example, the initiator assembly 14' can include an initiator chip 46' that can comprise an exploding foil initiator 100', but it will be appreciated that other types of devices, such as an exploding bridge wire initiator, could be used in the alternative.

Briefly, the initiator assembly 14' can include a frame member 44' that can have a body **44*a*', which can be formed of an insulating material, and a pair of contacts 430*a* and 430*b*. The body 44*a*' can define a plurality of terminal apertures 90', which can be configured to receive an associated one of the terminals 52' therethrough, and an interior aperture 92' that can be sized to receive the exploding foil energetic material initiation device 100'. The contacts 430*a* and 430*b* can be coupled to the body 44*a*' in any desired manner, such as vapor deposition, and can be configured to electrically couple each of the terminals 52' to a respective one of the contacts 48'. Alternatively, each of the contacts 48' can be configured to electrically couple an associated one of the bridge contacts (i.e., bridge contact 104' or bridge contact 106') directly to an associated one of the terminals 52'. In an manner that is similar to the example of FIG. 11, the bridge 108' of the exploding foil energetic material initiation device 100' is disposed radially outward from the central axis of the housing assembly 12' to position the input charge 16 in closer proximity to the first and second switch contacts 138 and 140**.

The input sleeve 18' can be formed of an appropriate material, such as steel, and is configured to support the input charge 16 within the internal cavity 404. The input sleeve 18' can be fully or partly received in the pocket 424 over its height such that the portions of the input sleeve 18' that are not adjacent to the grounding switch **26*a* are electrically insulated from the housing 400. In this regard, the pocket 424 of the spacing member 402 can position the input sleeve 18' at a predetermined minimum distance from the interior surface of the housing 400**, such as a minimum distance of about 0.03 inch.

Figure 14:
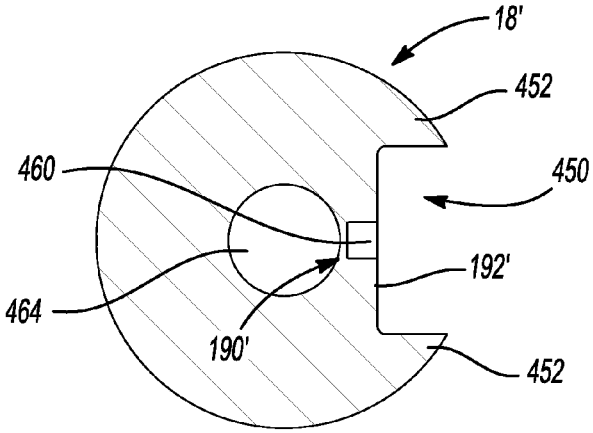
FIG. 14 is a section view of a portion of the energetic material initiation device of FIG. 12 illustrating the input sleeve in more detail.
Figure 15:
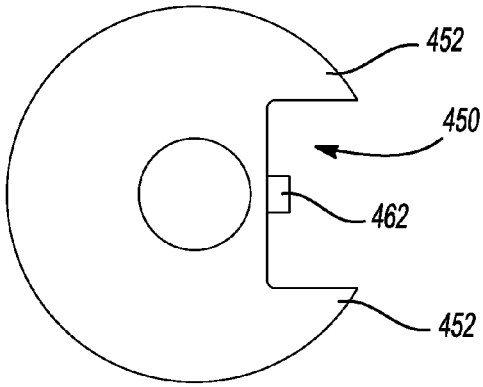
FIG. 15 is a plan view of an alternately constructed input sleeve.

With brief reference to FIG. 14, the input sleeve 18' can define a switch aperture 450 and a pair of arm members 452. The switch aperture 450 can be configured to receive the grounding switch **26*a*, while the arm members 452 can be configured to abut and support the opposite sides of the grounding switch 26*a*. The arm members 452 can contact the second insulating member 144 of the grounding switch 26*a* and can help to resist movement of the first and second switch members 138 and 140 laterally away from one another in response to energy released from the input charge 16 when the input charge 16 detonates so that the energy is directed axially through the first and second switch members 138 and 140 which may help to expedite the closure of the grounding switch 26*a*. If desired, one or more features may be formed into the flat planar edge 192', such as a blind or through aperture 460 or a projection 462 (FIG. 15). The aperture 460 can define or help to define the weakened zone 190' and moreover can direct a portion of the energy released by the detonation of the input charge 16 and/or a fragmented portion of the input sleeve 18' (e.g., a portion of the input sleeve 18' lying between the bottom of the aperture 460 and the inside surface of the hole 464 into which the input charge 16 is received), which can be directed out of the aperture 460 and toward the grounding switch 26*a* in a manner that is similar to a shotgun. If desired, the aperture 460 could be fully or partly filled with a suitable secondary explosive and/or with material (i.e., one or more projectiles) that are intended to be close or aid in the closing of the grounding switch 26*a* upon after being expelled from the aperture 460 upon detonation of the input charge 16. In the particular example provided, the aperture 460 has a diameter of about 0.03 inch and a depth that leaves about 0.02 inch to about 0.08 inch of material between the bottom surface of the aperture 460 and the inside surface of the hole 464 (as measured along a line that is perpendicular to the bottom surface of the aperture 460 and intersects the central or longitudinal axis of the hole 464); we presently believe that this portion of the input sleeve 18' shears from the remainder of the input sleeve 18' when the input charge 16 detonates and that the energy released by the input charge propels this portion of the input sleeve 18' through the aperture 460**.

Returning to FIGS. 12 and 13, the barrier system 20' can be configured to attenuate the energy released during detonation of the input charge 16, for example to initiate combustion or deflagration in the output charge 24. It will be appreciated that for some types of initiators, such as detonators, attenuation of the energy released during detonation of the input charge 16 may be unnecessary or undesirable and as such, a barrier system may not be included in some initiators constructed in accordance with the teachings of the present disclosure.

In one exemplary form, the barrier system 20' can comprise a first barrier structure 200' and a second barrier structure 202'. The first barrier structure 200' can include a cup-shaped structure having a bottom wall 210' and an annular side wall 212' that cooperate to form a cavity 214'. The thickness of the bottom wall 210' can vary depending on several design factors, including the material and size of the input charge 16 and, the material and size of the output charge 24, and whether or not the first barrier structure 200' is intended to rupture. In the particular example provided, the bottom wall 210' can have a nominal thickness of about 0.020 inch to about 0.080 inch and preferably about 0.040 inch to about 0.060 inch. If desired, the bottom wall 210' can have a structurally weakened zone, which may be formed for example by a recess 470 in one or both of the surfaces of the bottom wall 210'. The first barrier structure 200' can be formed of a material such as 304 stainless and can be positioned in-line with the input charge 16. The annular side wall 212' can extend upwardly away from the initiator assembly 14.

The second barrier structure 202' can be disposed on a side of the first barrier structure 200' on a side opposite the cavity 214' (i.e., between the first barrier structure 200' and the input charge 16). The second barrier structure 202' can at least partially burn in response to the high heat and pressure of the detonating input charge 16 to thereby ignite the output charge 24. In the example illustrated, the second barrier structure 202' is a composite that includes a reactable member 230, which can be formed from a metal such as titanium or another suitably reactive material that is inert under normal circumstances, and an oxidizer member 232, which can be formed from a material such as TEFLON® (i.e., polytetrafluoroethylene). In the particular example provided, the reactable member 230 is formed of titanium and has a thickness of about 0.001 inch, while the oxidizer member 232 is formed of TEFLON® and has a thickness of about 0.001 inch.

The output charge 24 can be formed from a suitable material, such as a material that may be used for initiating ignition or deflagration in a pyrotechnic material. In the example provided, the output charge 24 is formed from boron potassium nitrate ($BKNO_3$) and can be disposed within the cavity 214' in the first barrier structure 200'. The cover 32' can comprise one or more discrete components and is configured to sealing close the internal cavity 404. In the example provided, the cover 32' comprises a relatively thin closure disc 480, which is intended to rupture in response to ignition or deflagration of the output charge 24, and a support ring 482 that can be fixedly coupled to the housing 400 in a suitable manner (e.g., adhesives, welding, threads) and can overlie the closure disc 480 to retain the closure disc 480 within the internal cavity 404. Optionally, a resilient member (not shown), such as a silicone rubber washer, can be disposed between the output charge 24 and the cover 32'.

An annular insulator 280' can be positioned between the input sleeve 18' and the first barrier structure 200'. The insulator 280' can be formed of a dielectric material and can define a pocket 492 that is configured to fully or partly receive the input sleeve 18' over its height such that portions of the input sleeve 18' that are not adjacent to the grounding switch 26*a* are electrically insulated from the housing 400. In the particular example provided, the input sleeve 18' is partly received into both the pocket 424 in the spacing member 402 and in the pocket 492 in the insulator 280' such that the input sleeve 18' is tightly trapped and a relatively short gap is disposed axially between the spacing member 402 and the insulator 280'. While the insulator 280' may be unitarily formed, the insulator 280' in the present example is formed in two longitudinal halves or clam shells. The halves of the insulator 280' may be formed as discrete and separate components, or could be formed with a living hinge.

If employed, the insulator 280' can be configured to space the input sleeve 18' apart from the first barrier structure 200' by a desired distance to maintain electrical separation between the first barrier structure 200' and the housing 400, which can effectively reduce the effect of the time lag between the initiation of the detonation event in the input charge 16 and the closing of the grounding switch 26*a*. We have found that a spacing of 0.025 inch to 0.100 inch between the input sleeve 18' and the first barrier structure 200' can be advantageous in some circumstances, with the spacing being preferably 0.030 inch to 0.080 inch, more preferably 0.040 inch to 0.070 inch and most preferably 0.045 inch to 0.065 inch. It will be appreciated, however, that other spacings can be employed. In some instances where the height of the initiator cannot exceed a predetermined dimension, it may be necessary to heavily compact the output charge 24. For example, charges of BKNO3, which are normally compacted to 5 ksi in prior art initiators can be compacted to 20-40 ksi to reduce the overall height of the output charge 24.

The grounding switch 26*a* is coupled to the terminals 52' in the manner described above in conjunction with the energetic material initiation device 10 of FIG. 1. In this regard, the first and second grounding contacts 130' and 132' can be disposed on a side of the frame 44' opposite the contacts 430*a* and 430*b* and can be soldered to a respective one of the terminals 52'. It will be appreciated that positioning of the first and second grounding contacts 130' and 132' under the frame 44' provides protection from the detonation event and as such, can help to maintain electrical connection between the first and second grounding contacts 130' and 132' with their associated terminal 52' if this feature is incorporated into the energetic material initiation device.

Figure 17:
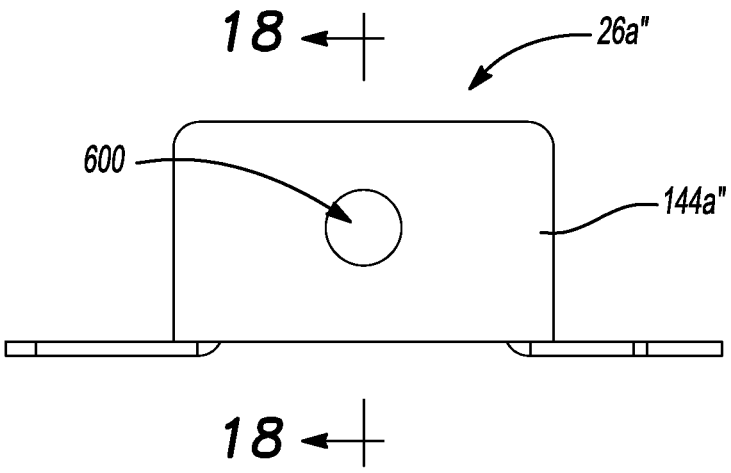
FIG. 17 is a portion of another energetic material initiation device constructed in accordance with the teachings of the present disclosure illustrating an alternately constructed switch.
Figure 18:
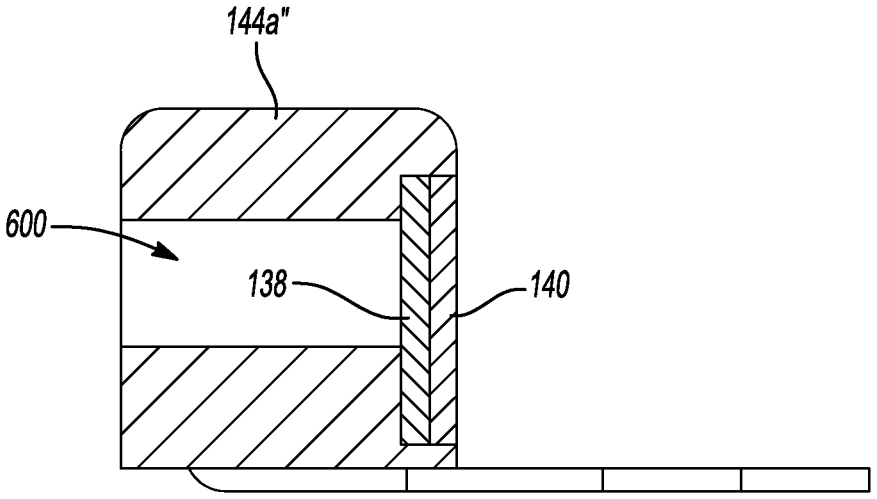
FIG. 18 is a section view taken along the line 18-18 of FIG. 17.

In FIGS. 17 and 18, a grounding switch 26*a*" is illustrated that is identical to the grounding switch 26*a*' of FIG. 13 except for the inclusion of a weakened zone 600 in the second insulating member 144*a*". The weakened zone 600 can be formed in any desired manner, such as a hole that extends rearwardly from the first switch contact 138. The weakened zone 600 need not be open on the end opposite the first switch contact 138 but rather could be formed as an empty pocket or merely in a thinner manner. The weakened zone 600 is configured to provide less support to the first and second switch contacts 138 and 140 (relative to the surrounding area) so that the grounding switch 26*a*" may be closed more readily and/or closed permanently.

From the forgoing, it will be appreciated that the detonation of the input charge provides feedback that can be employed to close the grounding switch so that the grounding switch, which is normally maintained in an open state, is incapable of closing without the feedback from the detonation event.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. A device comprising:

a housing assembly that defines a cavity;

an input charge disposed in the cavity, the input charge being formed of a secondary explosive;

an output charge formed of an energetic material that is configured to release energy in response to energy received from detonation of the input charge;

first and second terminals received through the housing assembly and extending into the cavity;

an exploding foil initiator that is disposed in the cavity, the exploding foil initiator being electrically coupled to the first terminal and being configured to initiate a detonation event in the input charge in response to receipt of an electrical pulse applied to the exploding foil initiator through the first terminal; and a switch having a first contact and a second contact, the first contact being electrically coupled to the second terminal, the second contact being electrically coupled to the first terminal, the switch being maintained in an open state and closing within 5 microseconds after the operation of the exploding foil initiator.

2. The device of claim 1, wherein the switch closes within 2 microseconds after the operation of the exploding foil initiator.

3. The device of claim 2, wherein the switch closes within 1.2 microseconds after the operation of the exploding foil initiator.

4. The device of claim 1, wherein the closing of the switch is temporary.

5. A device comprising:

a housing assembly that defines a cavity;

an input charge disposed in the cavity, the input charge being formed of a secondary explosive;

first and second terminals received through the housing assembly and extending into the cavity;

an exploding foil initiator that is disposed in the cavity, the exploding foil initiator being electrically coupled to the first terminal and being configured to initiate a detonation event in the input charge in response to receipt of an electrical pulse applied to the exploding foil initiator through the first terminal; and a switch having a first contact and a second contact, the first contact being electrically coupled to the second terminal, the second contact being electrically coupled to the first terminal, the switch being maintained in an open state and closing after operation of the exploding foil initiator to limit a current discharged from the first terminal to the housing assembly to less than 100 amps when a current in excess of 500 amps is employed to initiate the operation of the exploding foil initiator.

6. The device of claim 5, wherein the switch is configured to close after operation of the exploding foil initiator to limit the current discharged from the first terminal to the housing to less than 20 amps.

7. The device of claim 6, wherein the switch is configured to close after operation of the exploding foil initiator to limit the current discharged from the first terminal to the housing to less than 10 amps.

8. The device of claim 7, wherein the switch is configured to close after operation of the exploding foil initiator to limit the current discharged from the first terminal to the housing to less than 2 amps.

9. The device of claim 5, wherein the switch is configured to close within 5 microseconds after the operation of the exploding foil initiator.

10. The device of claim 9, wherein the switch closes within 2 microseconds of the operation of the exploding foil initiator.

11. The device of claim 10, wherein the switch closes within 1.2 microseconds of the operation of the exploding foil initiator.

12. A device comprising:

a housing assembly that defines a cavity;

an input charge disposed in the cavity, the input charge being formed of a secondary explosive;

first and second terminals received through the housing assembly and extending into the cavity;

an initiator assembly that is disposed in the cavity, the initiator assembly being electrically coupled to the first terminal and being configured to initiate a detonation event in the input charge in response to receipt of an electrical pulse applied to the initiator assembly through the first terminal; and a switch having a first contact and a second contact, the first contact being electrically coupled to the second terminal, the second contact being electrically coupled to the first terminal, the switch being maintained in an open state;

wherein energy released from the detonation of the input charge is employed in the closing of the switch to limit the discharge of electrical energy from the first terminal to the housing assembly.

13. The device of claim 12, wherein a current in excess of 500 amps is required to operate the initiator assembly and wherein less than 100 amps are discharged from the first terminal to the housing assembly.

14. The device of claim 13, wherein less than 20 amps are discharged from the first terminal to the housing assembly.

15. The device of claim 14, wherein less than 10 amps are discharged from the first terminal to the housing assembly.

16. The device of claim 15, wherein less than 2 amps are discharged from the first terminal to the housing assembly.

17. The device of claim 12, wherein the switch is configured to close within 5 microseconds after the operation of the initiator assembly.

18. The device of claim 17, wherein the switch closes within 2 microseconds of the operation of the initiator assembly.

19. The device of claim 18, wherein the switch closes within 1.2 microseconds of the operation of the initiator assembly.

20. A device comprising:

a housing assembly that defines a cavity;

an input charge disposed in the cavity, the input charge being formed of a secondary explosive;

an output charge formed of an energetic material that is configured to release energy in response to energy received from detonation of the input charge;

first and second terminals received through the housing assembly and extending into the cavity;

an initiator assembly that is disposed in the cavity, the initiator assembly being electrically coupled to the first terminal and being configured to initiate a detonation event in the input charge in response to receipt of an electrical pulse applied to the initiator assembly through the first terminal; and a switch having a first contact and a second contact, the first contact being electrically coupled to the second terminal, the second contact being electrically coupled to the first terminal, the switch being maintained in an open state and closing in response to receipt of energy generated by the detonation event, the switch closing within 5 microseconds after the initiator assembly initiates the detonation event.

21. The device of claim 20, wherein the switch closes within 2 microseconds after the operation of the initiator assembly.

22. The device of claim 21, wherein the switch closes within 1.2 microseconds after the operation of the initiator assembly.

23. The device of claim 20, wherein the closing of the switch is temporary.

24. The device of claim 20, wherein the initiator assembly includes an exploding foil initiator.

25. A device comprising:

a housing assembly that defines a cavity;

an input charge disposed in the cavity, the input charge being formed of a secondary explosive;

an output charge formed of an energetic material that is configured to release energy in response to energy received from detonation of the input charge;

an initiator assembly that is disposed in the cavity, the initiator assembly being configured to initiate a detonation event in the input charge; and a switch that is not used to operate or to control the operation of the initiator assembly, the switch being maintained in an open state and closing in response to receipt of energy generated by the detonation event, the switch closing within 5 microseconds after the initiator assembly initiates the detonation event;

wherein the initiator assembly includes an exploding foil initiator.

26. The device of claim 25, wherein the switch closes within 2 microseconds after the operation of the initiator assembly.

27. The device of claim 26, wherein the switch closes within 1.2 microseconds after the operation of the initiator assembly.

28. The device of claim 25, wherein the closing of the switch is temporary.

* * * * *